United States Patent [19]

Field

[11] Patent Number: 5,059,304

[45] Date of Patent: Oct. 22, 1991

[54] PROCESS FOR REMOVING SULFUR FROM A HYDROCARBON FEEDSTREAM USING A SULFUR SORBENT WITH ALKALI METAL COMPONENTS OR ALKALINE EARTH METAL COMPONENTS

[75] Inventor: Leslie A. Field, San Francisco, Calif.

[73] Assignee: Chevron Research Company, San Francisco, Calif.

[21] Appl. No.: 277,932

[22] Filed: Nov. 30, 1988

Related U.S. Application Data

[63] Continuation-in-part of Ser. No. 161,260, Feb. 12, 1988, abandoned, which is a continuation of Ser. No. 734,439, May 16, 1985, abandoned, which is a continuation-in-part of Ser. No. 667,502, Oct. 31, 1984, abandoned.

[51] Int. Cl.[5] ..... C10G 61/06

[52] U.S. Cl. ..... 208/99; 208/138; 208/217

[58] Field of Search ..... 208/217, 226, 230, 212, 208/210, 213, 89, 99, 138

[56] References Cited

U.S. PATENT DOCUMENTS

| | | | |
|---|---|---|---|
| 1,904,381 | 4/1933 | Morrell | 208/230 |
| 2,542,970 | 2/1951 | Jones | 208/217 |
| 3,085,972 | 4/1963 | Krane | 208/99 |
| 3,598,535 | 8/1971 | Wennerburg | 208/230 |
| 3,694,350 | 9/1972 | Wennerburg | 208/212 |
| 4,127,470 | 11/1978 | Baird, Jr. et al. | 208/226 |
| 4,741,819 | 5/1988 | Robinson et al. | 208/65 |

*Primary Examiner*—Anthony McFarlane

*Attorney, Agent, or Firm*—Burns, Doane, Swecker & Mathis

[57] ABSTRACT

A process is disclosed for removing sulfur from a naphtha feedstream comprising contacting a naphtha feed with a platinum on alumina sulfur conversion catalyst under mild reforming conditions so that thiophenic and other organic sulfur compounds are converted to hydrogen sulfide without any significant cracking of the naphtha feed. Thereafter, the naphtha feed stream is contacted with a sulfur sorbent that has a metal component selected from Group I-A or Group II-A of the Periodic Table supported on a refractory inorganic oxide support, to remove hydrogen sulfide from the naphtha feed.

6 Claims, 1 Drawing Sheet

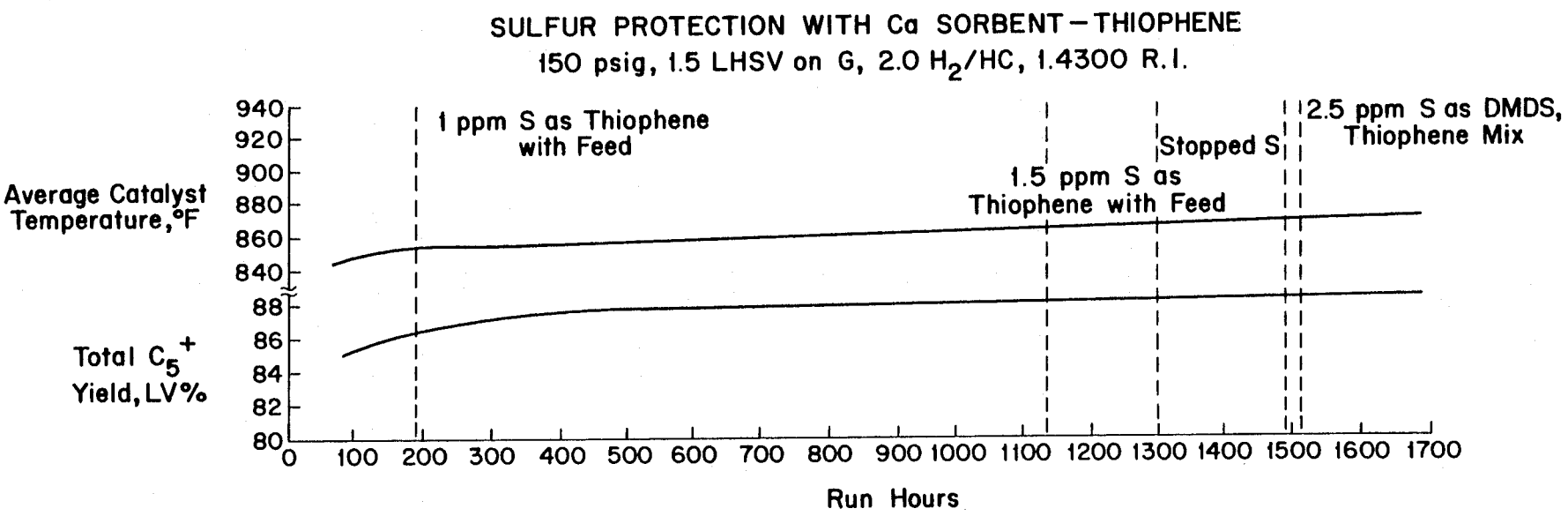
SULFUR PROTECTION WITH Ca SORBENT—THIOPHENE
150 psig, 1.5 LHSV on G, 2.0 H2/HC, 1.4300 R.I.
1 ppm S as Thiophene with Feed
1.5 ppm S as Thiophene with Feed
Stopped S
2.5 ppm S as DMDS, Thiophene Mix
Average Catalyst Temperature, °F
940
920
900
880
860
840
Total C5+ Yield, LV%
88
86
84
82
80
0
100
200
300
400
500
600
700
800
900
1000
1100
1200
1300
1400
1500
1600
1700
Run Hours

PROCESS FOR REMOVING SULFUR FROM A HYDROCARBON FEEDSTREAM USING A SULFUR SORBENT WITH ALKALI METAL COMPONENTS OR ALKALINE EARTH METAL COMPONENTS

BACKGROUND OF THE INVENTION

This application is a continuation-in-part of application Ser. No. 07/161,260 filed 2/12/88, now abandoned, which is and continuation of application Ser. No. 06/734,439 filed 5/16/85, now abandoned, which is a continuation-in-part of application Ser. No. 06/667,502 filed 10/31/84, now abandoned.

This invention relates to a process for removing sulfur compounds from the feedstreams to a catalytic reformer. More particularly, this invention relates to a process for removing sulfur compounds with a composition of matter of either Group I-A or Group II-A metal components supported on a refractory inorganic oxide.

Catalytic reforming processes play an integral role in upgrading naphtha feedstocks to high octane gasoline blend stocks. These processes have become more important in recent years because of the increase in demand for low-lead and unleaded gasolines.

In typical modern reforming processes, the naphtha feed is passed over a promoted noble metal catalyst at a temperature in the range of 315° C. to 595° C., a pressure in the range of from 1 atmosphere to 70 atmospheres, a liquid hourly space velocity (LHSV) in the range of 0.1 to 10, and a hydrogen to hydrocarbon mole ratio in the range of 1 to 10. Variations in these conditions will depend in large measure upon the type of feed processed and the desired product octane level.

It is generally recognized that the sulfur content of the feedstock must be minimized to prevent poisoning of the reforming catalyst. Preferably, the feed will contain less than 2 to 5 parts per million by weight (ppm) of sulfur, since the presence of sulfur in the feed decreases both the activity and the selectivity of the catalyst. Certain reforming catalysts are extremely sulfur sensitive, and sulfur levels in the feed of even less than 1 ppm can severely deactivate these catalysts.

Sulfur sorbents can remove nearly all of the sulfur present in the feed at the high temperatures used in reforming. One sulfur sorbent that is used at low temperatures is a metal or metal compound, such as copper, which is supported on a porous refractory inorganic oxide support or on a carbon support. An example of such a sorbent is disclosed in U.S. Pat. No. 4,204,947. That sorbent is copper supported on alumina. Other similar sorbents are disclosed in U.S. Pat. Nos. 2,593,464 and 4,224,191. Copper on alumina works well as a sorbent for $H_2S$ or mercaptan type sulfur, but copper sorbents tend to be less effective at higher temperatures, removing less sulfur as the temperature goes above 300° C. Furthermore, copper sorbents do not work on some types of sulfur which can be present in the reforming feed, such as thiophenic sulfur. Also, copper is costly.

Various promoter metals have been used in conjunction with copper. For example, U.S. Pat. No. 4,008,174 discloses copper and chromium on a carbon support. The chromium aids in regeneration of the sorbent.

SUMMARY OF THE INVENTION

The present invention is a novel process for removing sulfur from hydrocarbon feedstreams by using a metal component selected from Group I-A or Group II-A of the Periodic Table supported on a porous refractory inorganic oxide support Preferred metal components include sodium, potassium, calcium, and barium. Preferred refractory inorganic oxide supports include alumina, silica, titania, zirconia, aluminosilicates, aluminophosphates, and mixtures thereof.

One preferred method of making these sulfur sorbents is by impregnating a preformed porous refractory inorganic oxide support with an aqueous solution of a metal salt where the metal is selected from Groups I-A or II-A of the Periodic Table, and drying and calcining the resulting material.

An alternative method is by peptizing a refractory inorganic oxide support, thereby forming a plastic mass, mulling the mass with a compound containing a Group I-A or Group II-A metal, then extruding the mass, and drying and calcining it.

In the process of the present invention, a naphtha feed is contacted with a platinum on alumina sulfur conversion catalyst under mild reforming conditions so that thiophenic and other organic sulfur compounds are converted to hydrogen sulfide without any significant cracking of the naphtha feed. Thereafter, the naphtha feed containing the converted sulfur compounds is contacted with the sulfur sorbent which quantitatively removes the hydrogen sulfide. The present process selectively desulfurizes a naphtha feed without significant cracking of the naphtha feed to lighter products.

Specifically, the present invention is directed to a process for removing sulfur and sulfur compounds from a naphtha feed comprising:

(a) contacting a naphtha feed with a platinum on alumina catalyst in the presence of added hydrogen so as to convert thiophenic or organic sulfur compounds to hydrogen sulfide under mild reforming conditions wherein the temperature is no greater than about 500° C. and the pressure is no greater than about 250 psig whereby there is no significant cracking of the naphtha feed; and (b) contacting the naphtha from step (a) with a sulfur sorbent which comprises a Group I-A or Group II-A metal supported on a porous refractory inorganic oxide support to remove hydrogen sulfide from the naphtha feed.

BRIEF DESCRIPTION OF THE DRAWING

The appended drawing is supplied as an aid to understanding of this invention. This drawing is only exemplary, and it should not be construed as limiting the invention. The drawing is a plot of the average catalyst temperature of an exemplary material required to maintain the target refractive index of the $C_{5+}$ liquid product at 1.4300, which corresponds to about 47 wt% aromatics in the product.

DETAILED DESCRIPTION OF THE INVENTION

A refinery produces naphtha fractions having substantial amounts of sulfur in the form of organic sulfides, such as thiophenes and mercaptans. Sometimes the sulfur level is higher than 100 ppm in the untreated naphtha fraction. These feeds with very high sulfur levels can be contacted with hydroprocessing catalysts to convert the organic sulfur compounds to $H_2S$ which can be more easily removed. If the remaining sulfur level is too high, then the high sulfur level can cause the reforming catalyst to rapidly lose both activity and selectivity when used for reforming. Prudent operation demands that heavily sulfur contaminated feeds be further treated before contacting sulfur sensitive catalysts.

Preferably, the first step of the reforming process of the present invention is carried out under sulfur conversion conditions at a pressure no greater than about 500 psig, more preferably at a pressure no greater than about 300 psig. Preferably, this first reforming step is carried out at a temperature of from about 300° C. to about 500° C., more preferably from about 350° C. to about 480° C. The liquid hourly space velocity of the naphthas in the conversion reactions is preferably between about 3 and 15.

Preferred supports for the sulfur sorbent include alumina, silica, titania, zirconia, boria, and the like, and mixtures thereof. Clays can also be used as supports. Particular clays of interest include the fibrous magnesium silicate clays, for example, attapulgite, palygorskite, halloysite and sepiolite. The support can be premade by any method known in the art.

The surface area of the finished sulfur sorbent is in large part due to the support chosen. It is believed that the active sulfur sorbents of this invention can have nitrogen surface areas in the range of between 20 and 300 $m^2/g$.

Since the sulfur sorbents of this invention can be used for removing sulfur from feedstreams for reforming units, one typical feedstock will be low molecular weight hydrocarbons which are in the vapor phase at reforming conditions. In particular, the feedstock will normally comprise alkanes and naphthenic compounds having between about five and twelve carbon atoms. Hydrogen may also be present, such as the recycle hydrogen stream of a reforming unit. Because vapors diffuse rapidly into the pores of the support material, the precise size and pore distributions are not thought to be critical in a sulfur sorbent for use in this application.

The metal components of the sulfur sorbents in this invention can be Group I-A or Group II-A metal containing compounds. The preferred metal components are sodium, potassium, calcium, and barium. The metal components are not in general present as the reduced metal. Instead, they are usually present in the form of a salt, oxide, hydroxide, nitrate, or other compound. It is the metal in the compound, in any form, that is the metal component of the sorbent of this invention. The sulfur sorbents of this invention can be made by impregnation of a preformed refractory inorganic oxide support with a metal component, or by comulling the metal component with the inorganic oxide support.

Preferred metal compounds include sodium chloride, sodium nitrate, sodium hydroxide, sodium carbonate, sodium oxalate, potassium chloride, potassium nitrate, potassium carbonate, potassium oxalate, potassium hydroxide, barium chloride, barium nitrate, barium carbonate, barium oxalate, barium hydroxide, calcium chloride, calcium nitrate, calcium carbonate, calcium oxalate, calcium hydroxide, and the like.

A preformed inorganic support can be impregnated with Group I-A or Group II-A metals by standard techniques. It may be necessary to impregnate the support several times to achieve the desired amount of metal component on the inorganic support. Various metal compounds can be dissolved to form aqueous solutions useful for this impregnation. The preferred compounds for impregnation are the more soluble compounds. To be useful for impregnation, a compound should have a solubility of at least 0.1 mole per liter of water.

Another method of making the sulfur sorbents of this invention is by mulling the powdered inorganic support material, which can be prepeptized or mixed in the presence of a peptizing agent, together with a compound containing a Group I-A or Group II-A metal. Preferred peptizing agents are mineral acids, such as nitric acid. For example, peptized alumina powder could be mixed with a metal component, such as potassium carbonate. The resulting mass is then shaped, extruded, dried and calcined to form the final sulfur sorbent.

The choice of the appropriate compound to use during fabrication of the sulfur sorbent is primarily dictated by the solubility of the salt. For example, in impregnation, very soluble salts are desired, such as nitrates, but in mulling, relatively insoluble salts, such as carbonates are preferred.

If sulfur is present that is not in the form of $H_2S$, it is preferred that the sulfur sorbent of this invention be preceded by small amounts of platinum or palladium on a suitable support. In the presence of added hydrogen, the added metals catalyze the conversion of thiophenic and another organic type sulfur compounds that may exist in the feedstream into easily sorbed sulfur compounds. When thiophenic and other organic sulfur compounds contact platinum and palladium, hydrogen sulfide is formed, which is readily removed by the sulfur sorbent. Preferably, a platinum on alumina conversion catalyst is used. Such catalysts are designed so that they will not substantially crack the naphtha feed under mild reforming conditions used for the sulfur conversion, since the use of cracking catalysts or conditions results in undesirable reactions and/or light end products.

Specifically, the naphtha feed is contacted with a platinum on alumina catalyst in the presence of added hydrogen so as to convert thiophenic or organic sulfur compounds to hydrogen sulfide under mild reforming conditions wherein the temperature is no greater than about 500° C. and the pressure is no greater than about 250 psig whereby there is no significant cracking of the naphtha feed.

The sorbent of this invention is used to remove sulfur from feedstocks containing sulfur levels as high as several percents to levels as low as 1 ppm (part per million) and lower. Typically, the sorbent and reforming catalyst are contained in separate vessels. The vessel containing the sulfur sorbent is typically placed upstream of the vessel containing the reforming catalyst. The feedstock may be heated to as high as the reforming reaction temperature or to a lower temperature before it contacts the sulfur sorbent; from ambient temperature to as high as 1000° F. (540° C.) and higher.

The sorbent can be placed in the same reaction vessel as the reforming catalyst. If the sorbent is given the proper porosity and shape it can be intermixed with the reforming catalyst in the same bed. As any residual organic sulfur is converted by the reforming catalyst to $H_2S$, the sorbent removes it, preventing harm to subsequent beds, and prolonging operational life of the system because the sorbent functions well at reforming temperatures.

The sorbent can safely contact the amounts of water normally found in reforming feedstreams. The feedstreams do not have to be as extraordinarily dry as they would if they were contacting the reduced, metallic form of alkali metals or alkaline earth metals and if this reduced, metallic form were required. Group I-A and Group II-A metals can form hydroxides or oxides in the water-containing stream. However, the water level in the hydrogen recycle stream should be kept low, preferably to less than 100 ppm, and more preferably to less than 50 ppm.

This sorbent can be used in combination with other sorbents. For instance, in one embodiment, the hydrocarbon feedstock is contacted with a hydrotreating catalyst to convert organic sulfur compounds in the feedstock; then contacted with a sorbent, such as zinc oxide or copper oxide, supported on a clay base, and then with the sorbent of the present invention.

EXAMPLES

In the following examples, the preformed gamma alumina base used was a commercially available 1/16th inch extrudate, with a $H_2O$ pore volume of approximately 0.7 cc/gm and a $N_2$ surface area of approximately 200 $m^2$/gm. It was calcined at 1250° F. It was made by peptizing a pseudoboehmite alumina of crystal size in the range of approximately 33 to 40 Angstroms as determined by X-ray diffraction (XRD) with an aqueous solution of a mineral acid, mixing it until it reached an extrudable state, then extruding, drying and calcining the resulting material.

Example I

This example shows a sulfur sorbent of this invention. The sorbent was prepared by taking 100 gm of pre-extruded alumina and impregnating it with 25.9 gm $KNO_3$ in 76 ml $H_2O$, by pore fill impregnation. The sorbent was dried for 16 hours at 250° F. and then calcined for 2 hours at 1100° F. 0.12 ml of a solution of 0.093 gm Pt/ml, where the form of Pt was $H_2PtCl_6$, in distilled water was then impregnated onto the support. It was dried for 48 hours at 250° F. and calcined for 2 hours at 500° F. This composition of matter will be identified as A.

Example II

This example shows another sulfur sorbent of this invention. 200 grams of pre-extruded alumina were impregnated with 0.22 ml of 0.093 gm Pt/ml, where the form of Pt was $H_2PtCl_6$, in 164 ml $H_2O$, under 30 inches of vacuum. The extrudate was then impregnated with 57.43 grams of potassium nitrate in 164 ml of water. The extrudate was dried at 250° F. overnight and then calcined for 2 hours at 1100° F. This composition of matter will be identified as B.

Example III

This example shows the manufacture of a monometallic reforming catalyst. 50 grams of pre-extruded alumina was impregnated under 30 inches of vacuum with 1.6 ml of an aqueous solution of $H_2PtCl_6$ of concentration 0.093 gm Pt/ml in 30 ml of $H_2O$. The impregnated alumina was allowed to stand for 2 hours and then dried at 250° F. overnight and then calcined for 2 hours at 950° F. in air. The catalyst produced can be used for reforming. This composition of matter will be identified as C.

Example IV 1000 gm of an L zeolite of crystal size between 1000 and 2000 Angstroms was mixed with 10 liters of 0.3 molar $Ba(NO_3)_2$ solution. The zeolite and solution were placed into 2 bottles. Lids were placed on the bottles and they were shaken. They were then placed into a preheated oven at 80° C. for 3 hours. Then the contents were filtered and washed with 2 liters of distilled water. The solids were dried for 16 hours at 250° F. and calcined for 16 hours at 1100° F. in air.

752.4 gm of smaller than 14 mesh powder made as above was impregnated with a solution of $Pt(NH_3)_4(NO_3)_2$ to 0.8 wt % Pt, in 752.4 ml of aqueous solution. This was then dried for 16 hours at 250° F., rescreened to <14 mesh, and calcined for 2 hours at 500° F. in air. This composition of matter will be identified as D.

Example V

This example was a standard reforming run using a sulfur sensitive reforming catalyst except that (1) there was no sulfur sorber; and (2) 1 ppm organic sulfur was added to the feed after 480 hours. The catalyst in this example was D. The results before and after sulfur addition are shown in the following table. After 600 hours, control of temperature to maintain the required aromatics content was no longer possible due to rapid catalyst deactivation. After 670 hours, the addition of sulfur to the feed was discontinued, and clean feed was used. No recovery of activity was observed during 50 hours of clean feed operation. In addition, the feed was withdrawn at 720 hours, and the catalyst was stripped with sulfur-free hydrogen gas for 72 hours at 930° F. Only a small gain in activity was observed.

| Run time, Hrs. | For 50 wt % Aromatics In Liquid, Temperature °F. | $C_5$+ Yield LV % |
|---|---|---|
| 200 | 862 | 84.5 |
| 400 | 866 | 85.4 |
| 480 | 868 | 84.8 |
| 550 | 882 | 86.1 |
| 600 | 908 | 86.2 |

Example VI

This example was run as shown in Example V, except that 0.5 ppm mercaptan-type sulfur was added to the feed from 270 hours to 360 hours on stream, and again from 455 hours to 505 hours on stream. After 450 hours, control of temperature to maintain the required aromatics content was no longer possible due to rapid catalyst deactivation. The results are shown below:

| Run time, Hrs. | For 50% wt % Aromatics In Liquid Temperature °F. | $C_5$+ Yield LV % |
|---|---|---|
| 200 | 862 | 84.2 |
| 300 | 864 | 85.0 |
| 350 | 876 | 85.6 |
| 400 | 887 | 85.6 |
| 450 | 896 | 85.5 |
| 500 | 904 | 85.8 |

Example VII

Deionized water was added to 0.23 ml of a solution containing 0.093 gm Pt/ml, the Pt as $H_2PtCl_6$. The water was added until the total volume of the solution was 170 ml. This mixture was used to vacuum impregnate 200 gm of a preformed alumina extrudate. The impregnated extrudate was then allowed to stand for 2 hours at room temperature, and was then dried for 16 hours at 250° F.

Next, 294.6 gm of $Ca(NO_3)2:4H2O$ was mixed into 100 ml hot deionized water, and stirred until clear. The solution was then evaporated, cooled, and the volume adjusted to 170 ml. This solution was then used to impregnate the extrudate under vacuum. The extrudate then sat for 2 hours at room temperature, and was then dried at 250° F. overnight.

Finally, the material was calcined at 1100° F. in flowing air.

This material will be designated E.

Example VIII

To 3.2 ml of a solution of 0.093 gm Pt/ml, the Pt as $H_2PtCl_6$, was added deionized water until the total solution volume reached 80 ml. This solution was then used to impregnate 100 gms of a preformed alumina extrudate under vacuum. The extrudate was allowed to sit for 2 hours at room temperature and was then dried for 16 hours at 250° F. Finally, it was calcined for 2 hours in flowing air at 950° F.

This material will be designated F.

Example IX

To 1100 gm of an L zeolite was added 11 liters of an aqueous solution of 0.3 molar Ba as $Ba(NO_3)_2$. This mixture was placed in polypropylene bottles, the lids were closed, and the bottles were placed in a preheated 176° F. oven for 4 hours.

After 4 hours, the contents of the bottles were poured off into filters and the solids collected. The filter solids were reslurried in fresh deionized water and refiltered a total of 10 times.

The solids were then dried at 250° F. over a weekend, and calcined for 16 hours at 1100° F. in flowing air.

863.1 gm of the material was then screened to below 14 mesh. 0.8% Pt was added to the solids in a pore fill impregnation, using $Pt(NHY_3)_4(NO_3)_2$ as the Pt source, and 690.5 ml of total solution. The material was allowed to sit at room temperature for 2 hours and was then dried at 250° F. for 16 hours.

Finally, the material was treated at 500° F. for 4 hours in flowing air.

This material will be designated G.

Example X

This example shows the process of this invention. In a fixed bed tubular reactor, 25 cc of material F at 24 to 80 mesh was layered over 25 cc of material E at 24 to 80 mesh. This material was layered over 100 cc of material G, also at 24 to 80 mesh.

A naphtha feedstock of API gravity 67.0, boiling range as determined by D-86 distillation of start, 160° F.; 5% Pt. 167; 10% Pt. 169; 20% Pt. 171; 30% Pt. 173; 40% Pt. 175; 50% Pt. 177; 60% Pt. 180; 70% Pt. 183; 80% Pt. 190; 90% Pt. 208; 95% pt. 208; and end Pt. 254° F., and molecular type as determined by GC of 59.6 LV% paraffins, 36.6 LV% naphthenes, and 3.8 LV% aromatics, was fed over the catalyst at a 1.5 LHSV relative to the reforming catalyst G at a pressure of 150 psig and an $H_2/HC$ ratio of 2. Organic sulfur as thiophene was doped into the feed and fed at a 1 to 2.5 ppm S level, based on feed.

FIG. 1 is a plot of the catalyst average temperature of the material G required to maintain the target refractive index of the $C_{5+}$ liquid product of 1.4300, which corresponds to about 47 wt% aromatics in the liquid.

The Pt containing material F in front of the sorbent material E serves to convert the thiophenic sulfur to $H_2S$, a form readily sorbed by the material.

Note that the reforming catalyst G was not deactivated by the sulfur to any measurable extent. Sulfur analyses on various layers of the catalysts after the completion of the run showed 440 and 370 ppm of sulfur on the Pt-containing thiophene conversion catalyst F, 1.27% S and 1250 ppm S on the sorbent E, and 40, 24, and 18 ppm S on the reforming catalyst G.

The preceding examples are intended to illustrate various aspects of the preferred embodiments of the present invention. They are not intended, in any way, to limit the scope of the appended claims.

What is claimed is:

1. A process for removing sulfur and sulfur compounds from a naphtha feed comprising:

(a) contacting a maphtha feed with a platinum on alumina catalyst in the presence of added hydrogen so as to convert thiophenic or organic sulfur compounds to hydrogen sulfide under mild reforming conditions wherein the temperature is no greater than about 500° C. and the pressure is no greater than about 250 psig; and (b) contacting the naphtha from step (a) with a sulfur sorbent which comprises a Group I-A or Group II-A metal supported on a porous refractory inorganic oxide support to remove hydrogen sulfide from the naphtha feed.

2. The process of claim 1 wherein said porous refractory inorganic oxide support is selected from the group consisting of alumina, silica, zirconia, titania, and mixtures thereof.

3. The process of claim 1 wherein said porous refractory inorganic oxide support is selected from the group consisting of the clays attapulgite, halloysite, palygorskite, and sepiolite.

4. The process of claim 1 wherein said Group I-A and Group II-A metals are selected from the group consisting of sodium, potassium, barium, and calcium.

5. The process of claim 1 wherein the platinum on alumina conversion catalyst precedes the sulfur sorbent in one reforming reactor.

6. The process of claim 1 wherein the feed is contacted with the catalyst at a pressure of approximately 150 psig.

* * * * *